US007842867B2

(12) United States Patent
Schmidt

(10) Patent No.: US 7,842,867 B2
(45) Date of Patent: Nov. 30, 2010

(54) INTERNALLY-MOUNTED SOUNDHOLE INTERFACING DEVICE

(76) Inventor: Eric Schmidt, 402 N. Quentin, Wichita, KS (US) 67208

( * ) Notice: Subject to any disclaimer, the term of this patent is extended or adjusted under 35 U.S.C. 154(b) by 0 days.

(21) Appl. No.: 12/426,790

(22) Filed: Apr. 20, 2009

(65) Prior Publication Data

US 2009/0199695 A1 Aug. 13, 2009

Related U.S. Application Data

(63) Continuation of application No. 11/562,115, filed on Nov. 21, 2006, now abandoned.

(51) Int. Cl.
*G10D 3/02* (2006.01)

(52) U.S. Cl. ..... 84/291; 84/294; 84/267

(58) Field of Classification Search ..... 84/291
See application file for complete search history.

(56) References Cited

U.S. PATENT DOCUMENTS

| | | | | |
|---|---|---|---|---|
| 2,037,187 | A | 4/1936 | Wente | |
| 3,296,916 | A * | 1/1967 | Palmer | 84/1 |
| 3,931,753 | A * | 1/1976 | Dopera | 84/296 |
| 4,024,788 | A | 5/1977 | Dunlap | |
| 4,180,710 | A | 12/1979 | Spranger | |
| 4,632,003 | A | 12/1986 | Kopp | |
| 4,903,567 | A * | 2/1990 | Justus | 84/294 |
| 5,355,756 | A | 10/1994 | Geiger | |
| 5,689,074 | A | 11/1997 | Penridge | |
| 5,854,435 | A | 12/1998 | Kim | |
| 5,883,317 | A * | 3/1999 | Kornprobst | 84/294 |
| 5,883,322 | A | 3/1999 | Baker | |
| 6,103,961 | A | 8/2000 | Kaufman | |
| 6,639,134 | B2 * | 10/2003 | Schmidt | 84/291 |
| 6,681,661 | B2 * | 1/2004 | Lalonde | 84/267 |
| 7,074,992 | B2 | 7/2006 | Schmidt | |
| 2004/0050236 | A1 | 3/2004 | Geiger | |
| 2005/0235805 | A1 | 10/2005 | Farris | |

OTHER PUBLICATIONS

Select File History for related U.S. Appl. No. 11/562,115, dated Feb. 12, 2008 through Aug. 26, 2009, 44 pages.

* cited by examiner

*Primary Examiner*—Jeffrey Donels
*Assistant Examiner*—Christopher Uhlir
(74) *Attorney, Agent, or Firm*—Lathrop & Gage LLP

(57) ABSTRACT

Disclosed is a device for improving the tonal characteristics of a stringed instrument. This has been accomplished using a device that interfaces acoustically with the soundhole. The device inhabits space where sound energy waves tend to interfere and redirects the sound energy out of the soundhole. This prevents distortion and delivers more fullness in sound.

7 Claims, 2 Drawing Sheets

INTERNALLY-MOUNTED SOUNDHOLE INTERFACING DEVICE

RELATED APPLICATION

This application is a continuation application of U.S. patent application Ser. No. 11/562,115, filed Nov. 21, 2006, now abandoned, the disclosure of which is incorporated herein by reference.

BACKGROUND OF THE INVENTION

1. Field of the Invention

The present invention relates generally to the field of stringed instruments. More specifically, the present invention is related to the field of improving the tonal characteristics of a guitar through structural modification.

2. Description of the Related Art

The typical acoustic guitar has a hollow body. The body defines a resonance chamber therein. The chamber is contained by a forward panel of the body. This panel is commonly referred to as a "sound board." The sound board includes a hole. This hole is referred to as the "sound hole." Connected to and extending back from the soundboard is a sideboard. This sideboard is completely closed off on its back edges by a backboard.

Typically, all of these components of the conventional guitar are constructed of choice pieces of wood. Composites or other materials may be used instead, however. The guitar also has a neck. One end of the neck is connected to the guitar body proximate the soundhole. The other end terminates in a headstock. On the headstock, one end of the strings are strung in a direction along the neck towards the body, and attached to a bridge. The bridge is fixed to the soundboard. It serves as an anchor for the other end of the strings. The bridge is placed such that the strings extend over the soundhole. The bridge typically includes a saddle. The saddle transfers vibrations in the strings to the soundboard. This results in the vibration of the entire soundboard.

The conventional soundhole is simply a circular cut out portion of the flat soundboard. When these strings vibrate above it, the bodily configuration of the guitar, including the resonance chamber cooperate with the soundhole to amplify the sound created by the vibrating soundboard.

It has been discovered that the sound of the guitar may be improved by constructing its soundboard, sideboard, and back of particular woods and/or composites. Various kinds and numbers of strings have been selected to alter its sound.

It is also known that the actual body design of the guitar is acoustically significant. Conventional guitars normally have a narrowed waist. One practical aspect of the narrowed waist is that it makes it easier to play for the user. This is because the narrowed portion is made to rest easily upon the user's knee. However, this design also affects the sound. The resulting two widened areas in the resonance chamber are called bouts. There is one bout where the neck connects, which is smaller. There is a second bout where the bridge attaches which is slightly larger. It is known in the art that the particular sizes and shapes of these bouts and their relativity to one another has much to do with the tone that the guitar produces. Thus, manipulation of the bouts and their shapes will cause a guitar to sound different. It has been discovered that the size of the lower bout—when optimized—accentuates the tones in the lower register of the instrument. And it is also known that ideal configuration of the upper bout accentuates the tones in the higher register when the instrument is played.

It has also been known in the art to reshape soundholes to affect sound. One example of this is U.S. Pat. No. 6,639,134 issued to Applicant. The '134 patent introduced a technique of modifying soundhole edge configurations to acoustically improve guitars, violins, and other like stringed instruments.

Need for improvement exists, however, in the way the soundboard, back, resonance chamber, and other features of the stringed instrument cooperate with the soundhole for acoustical purposes. As discussed briefly above, these components serve to amplify the vibrations received from the strings and release the amplified sound from the resonance chamber through the soundhole. But the waves at many frequencies tend to collide at locations proximate to the soundhole. This wave collision is detrimental in that it causes some sound waves to be propagated from inside the resonance chamber to leave the soundhole out of phase. This creates undesirable distortion, and limits sound fullness.

SUMMARY OF THE INVENTION

The disclosed embodiments have overcome the acoustical deficiencies existent in conventional stringed musical devices. This has been done using a device which is included in the resonance chamber of the instrument.

In one embodiment, a surface on a portion of the device occupies a space beneath said soundhole such that it receives sound energy from the resonance chamber and reflects it out of the soundhole for the purpose of changing an acoustical characteristic of the instrument.

In another embodiment, the surface is arcuate in cross section. In another embodiment the cross sectional shape of the surface is linear and sloped upward towards the center of the soundhole.

BRIEF DESCRIPTION OF THE SEVERAL VIEWS OF THE DRAWINGS

The present invention is described in detail below with reference to the attached drawing figures, wherein.

DETAILED DESCRIPTION OF THE INVENTION

The disclosed embodiments provide a device and method for improving the tonal characteristics and amplification of a stringed instrument. This has been accomplished using a device that interfaces acoustically with the soundhole. Whereas conventional guitar body configurations diminish tonal qualities of the sound received from the stings and release out of phase sound through the soundhole, the interfacing device of the present invention prevents distortion and delivers more fullness in the sound propagated from inside the resonance chamber.

Figure 1:
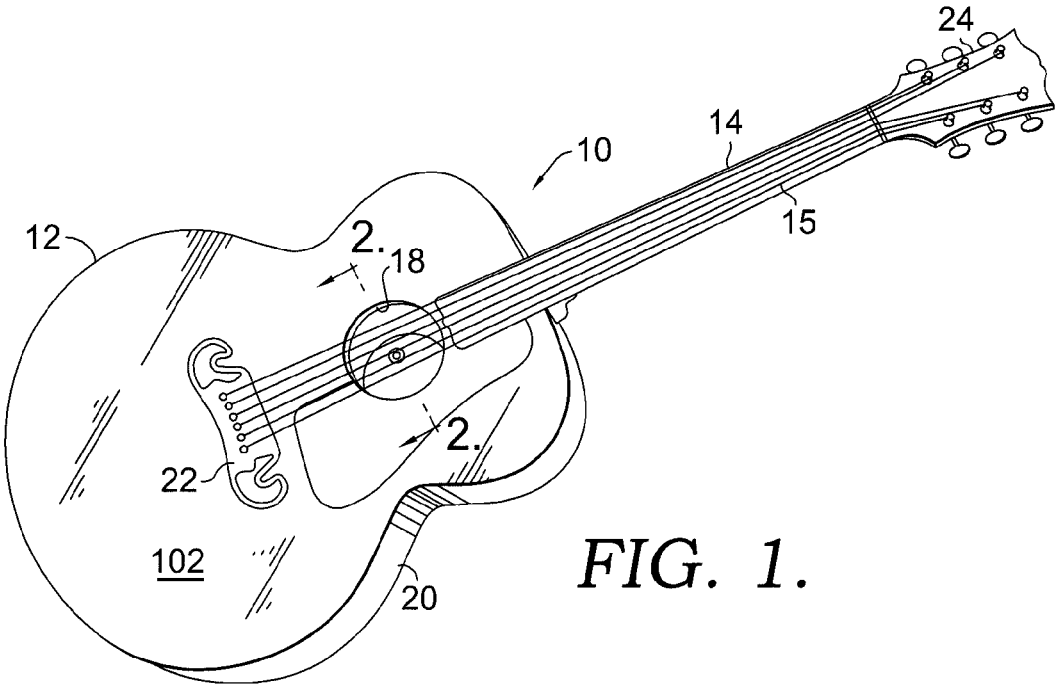
FIG. 1 is a perspective view of a guitar which includes a first embodiment of the internally-mounted soundhole interfacing device.
Figure 2:
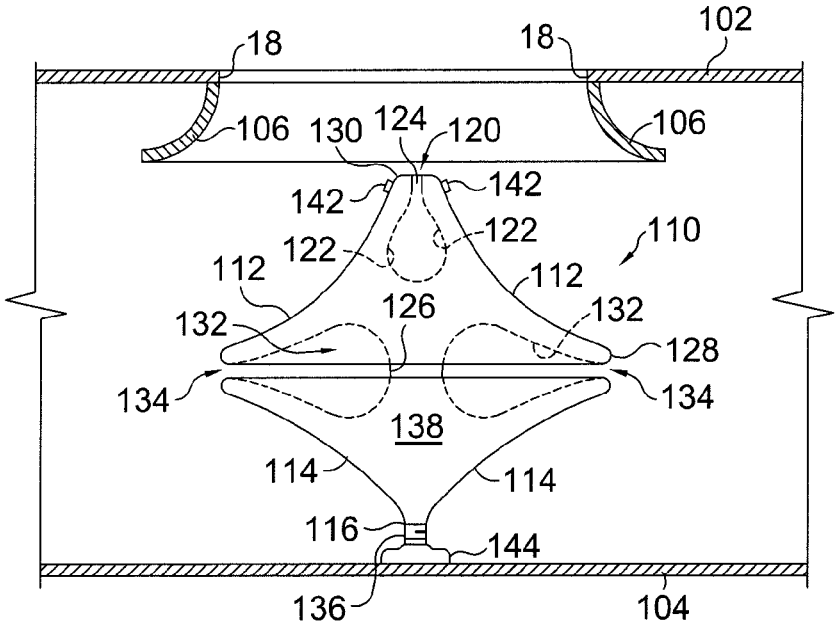
FIG. 2 is a sectional view showing the first embodiment of the internally-mounted soundhole interfacing device in its intended environment in the resonance chamber of a guitar. Surrounding guitar components are also shown.
Figure 3:
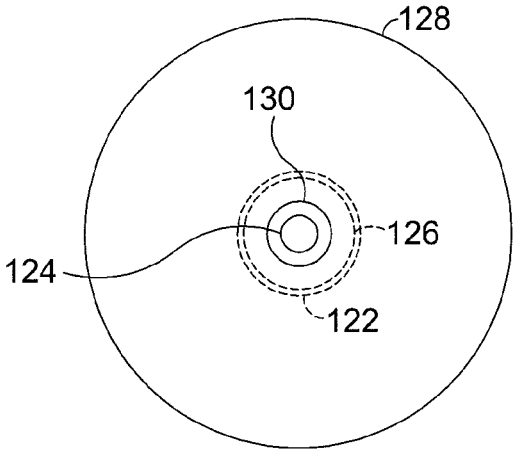
FIG. 3 is a view from above the upper end of the FIG. 2 embodiment of the device.
Figure 4:
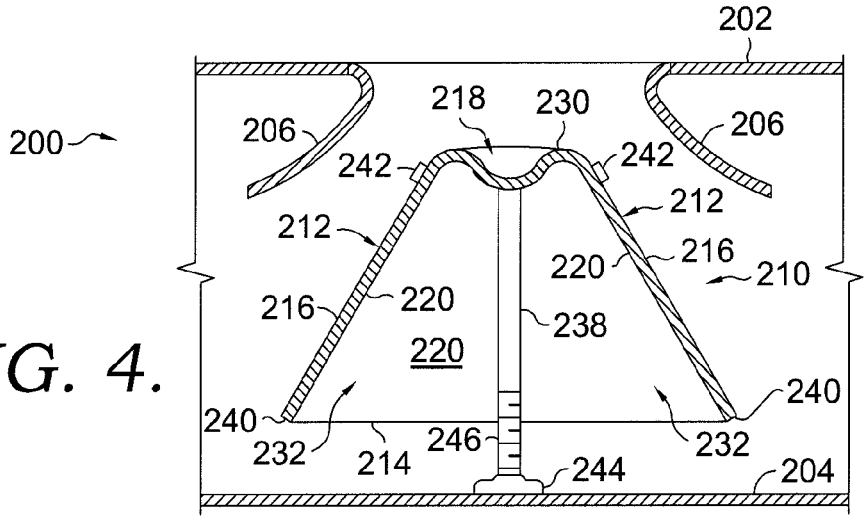
FIG. 4 is a sectional view showing a second embodiment of the internally-mounted soundhole interfacing device in its intended environment in the resonance chamber of a guitar. Surrounding guitar components are also shown.
Figure 5:
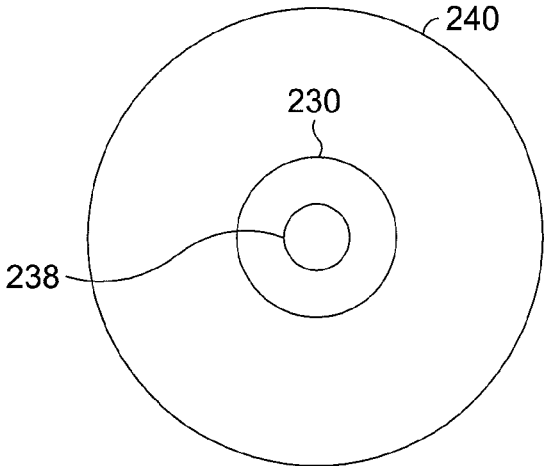
FIG. 5 is a view from above the upper end of the FIG. 4 embodiment of the device.

FIGS. 1-3 show a first embodiment of the present invention, and FIGS. 4-5 show a second embodiment. Referring first to FIG. 1, A guitar 10 is shown with a first embodiment 110 of the present invention installed therein. The guitar includes a body 12. Body 12 defines a resonance chamber therein (not shown). Fixed to body 12 at one end is a neck 14. Neck 14 is fixed at a proximate end to the body 12. At the other distal end, neck 14 has a head stock 24. Head stock 24 secures one end of the strings 15. The other end of the strings 15 are secured to a bridge that is fixed on the body 12. More specifically, the bridge 22 is fixed to the front planar soundboard 16 of the guitar. The guitar also has a side member 20 which extends all the way around the periphery of the soundboard 16. Soundboard 102 defines a soundhole 19 which has an edge 18. A back member (not shown) along with the side member 20 and the sound board 102 completes the body to enclose the resonance chamber.

The first embodiment of the internally-mounted soundhole interfacing device 110, partially visible in FIG. 1, can be seen in more detail in FIG. 2. The FIG. 2 illustration reveals that the device 110 is centered in and below soundhole 19 in soundboard 102 and supported on the back 104 of the guitar.

As can be seen in the figure, the edge 18 of the soundhole is flared inward as disclosed in U.S. Pat. No. 6,639,134 issued to Applicant, which is herein incorporated by reference. The earlier patent disclosed the flared inward designs in use on both guitar soundhole designs as well as more complex soundhole edge designs on violins and other related instruments which tend to have more ornate sound holes, similar to an "S" or "f" shape. The principles of the current invention would apply also to these more complex soundhole configurations as will be discussed in more detail hereinafter. Furthermore, the different configurations disclosed in the earlier patent could also be used in combination with the general principles demonstrated here regarding device 110.

With respect to the FIG. 2 embodiment, the inwardly flared edge 18 curves into the resonance chamber to define curved surfaces that affect the sound waves striking them. As sound waves move into the resonant chamber, they strike the various inner walls of the chamber, and the pressure created by the sound waves are expelled back out the sound hole. The resonance flanges provide an increase in volume to the vibrational sound waves, due to the bell or horn shape of the flanges, which effect the sound saves in a manner similar to how a trumpet horn or bell shape affects the sound emanating from the tube end of a trumpet. A unique and distinctively pleasing sound is also produced. But it should be understood that device 110 could be used in combination or separate from the flared soundhole edge 18 arrangement. Thus, although a flared edge 106 is shown in FIG. 2, a conventional flat soundhole arrangement could be used instead and still fall within the scope of the broad aspects of the present invention.

The internally-mounted soundhole interfacing device 110 of FIG. 2 has a tapered upper surface 112. When viewed in cross section, as shown in FIG. 2, surface 112 appears to be arcuately concave and ramps upward towards the center of the soundhole 19. Because of this shape, sound energy waves received from different locations in the resonance chamber will be directed up and out of soundhole 19 in phase.

It should be noted, that arcuate surface 112 when viewed in cross section as in FIG. 2, reveals two upwardly converging curves. Were device 110 not truncated at the top, but instead continued upward with the same geometrical configuration, the curves in cross section would meet at the center of the soundhole (in other words, where the plane of the soundhole meets the center axis of the soundhole). But because the top of device 110 is truncated, the curved surfaces 112 stop short of this.

For both the FIG. 2 and FIG. 4 embodiments herein, the soundhole is most narrow at the edge of the soundhole in the plane of the soundboard. But for other embodiments having different soundhole edge configurations, see, e.g., commonly owned U.S. Pat. Nos. 6,639,134 and 7,074,992, the positioning of the device would be such that the arcuate surfaces—if extended—would still converge horizontally at the soundhole center, but vertically at a point in the plane at which the pathway defined by the soundhole is most narrow.

It will be evident after looking at FIG. 3 that the device 110 is symmetrical about it's center vertical axis, and thus, arcuate surface 112 is the same all the way around the device. Device 110 also has a lower surface 114 that defines the lower outer shape of the interfacing device 110. When viewed in cross section or profile, surface 114 is arcuate and concave with a downward right focus.

A bottom portion 116 of the device includes a screw or other means to fix it to the back 104 of the guitar such that it can be stood upright below the soundhole 19. In the current embodiment, mechanisms are used which make the device vertically adjustable, which is discussed in more detail below.

In the upper regions of the device, a tear-drop shaped hollow or cavern 122 is formed which has an aperture 120 at the top enabling the cavern 122 to open up to the surroundings. It should be understood that the teardrop shaped hollow 122 is symmetrical about the vertical axis of the device 110. Horizontally, the hollow has a maximum horizontal dimension internal to the device, and a minimal horizontal dimension at a mouth 124 of the device.

At the midsection of the device 110, another hollowed out arrangement 132 exists which is symmetrical about the vertical axis of the device. Three dimensionally, the hollowed out portion is substantially toroidal. In cross section, the appearance is that of two opposed tear drops as shown in FIG. 2. The hollowed-out portion reaches an innermost point 126 on both sides. This defines a center support portion 138. The substantially-toroidal hollow 132 is opened up to the device surroundings by way of a horizontal slit 134.

In the FIG. 2 embodiment, device 110 includes a microphone arrangement. This arrangement includes one or more microphones 142 that are strategically placed proximate the top of the interfacing device 110. In terms of placement, a single microphone could be used. Or two or more dispersed intermittently about the upper tip of device 110. Alternatively, even more microphones could be radially clocked about the upper tip of insert 110. Regardless of the arrangement, all of these microphones may be electrically connected into a sound amplification system using wired or wireless technologies in numerous manners known to those skilled in the art.

Acoustically, device 110 maintains the amplified sound waves in phase. This is because when the sound waves emanating from the resonance chamber encounter device 110, they are maintained in phase. Different frequency waves, which are received from different locations in the resonance chamber, are normally distorted because the conventional soundhole does not maintain them in phase. This causes a significant neutralization at certain frequencies, the result is a unbalanced sound. But here, device 110 when it encounters high and low frequency waves, causes these waves to be deflected in phase from the sound hole. These waves, without the device, would tend to collide at an area immediately below the soundhole 19. By inserting device 110, they are deflected outward before collision. Thus, they are released from the soundhole in phase and with more intensity than if they were allowed to distort one another.

The shape of surface 112 enhances this process. As can be seen from FIG. 2, the gradual tapering of surface 112 as you move downward makes a sound-wave engaging area. This area receives and then deflects sound waves received from the resonance chamber through the soundhole. Further, it has been placed at the location that most of the wave collisions in a conventional guitar would occur. Thus, the waves are released undistorted and in phase.

Although the device 110 shows a tapering such that the cross section includes a concave arcuate surface 112 (see FIG. 2), it should be noted that other conical or other-shaped configurations could be used instead and still fall within the scope of what is currently claimed. For example, surface 112 could be flat and slanted, convex arcuate, or otherwise shaped and still fall within the scope of the broad functional objectives disclosed.

It should also be noted that the device could be asymmetrical about the vertical center axis. This might be desirable depending on the particular resonance chamber configurations, and or soundhole shapes. For example, if used on a violin, device 110 would no longer be symmetrical about it's center axis like is desired to interface with a circular guitar soundhole. For a violin the device would likely have a f-shaped hole to better interface with the f-shaped violin soundhole. Like with the FIG. 2 embodiment, the interfacing device for a violin would be secured to the back of the instrument, extend up to and underneath the f-hole, and be adapted to receive sound energy waves and project them up and out of the resonance chamber. Like with the guitar embodiment of FIG. 2, the violin embodiment could also include arcuately cross sectioned surfaces adapted to maintain the phase of the energy waves.

Returning to the specifics of the FIG. 2 embodiment, however, we see that the concavely arcuate cross sectional shape of the lower portion of device 110 contributes to the sound by preventing wave collision at the lower positions in the resonance chamber and bouncing them back away from the device so that they can ultimately be projected back out of the soundhole 19 undistorted.

The significant hollowness of the device created by caverns 122 and 132 also improves the acoustical effect. It has been found that by making the device hollow as with the preferred embodiment for device 110 sound is improved. Solid configurations, however, would also fall within the scope of the many embodiments possible with the disclosed inventive concepts.

The device 110 also includes a vertical adjustment arrangement. This arrangement is made possible using threads 136 on lower portion 116. These threads 136 are received by reciprocating threads (not shown) in a vertical bore made through a receiving member 144. Receiving member 144 is mounted internally on the backboard 104 of the guitar. Thus, but rotating device 110, it can be raised and lowered to different vertical positions beneath soundhole 19. This makes the device 110 tunable, which may be necessary depending on the guitar.

A second embodiment of the internally-mounted soundhole interfacing device 210 is shown in FIG. 4. The FIG. 4 embodiment has more of an umbrella shape. Like with the FIG. 2 embodiment, the FIG. 4 embodiment exists in the environment of the resonance chamber of a guitar having a soundboard 202, and a back 204. This version also includes an arcuately inward edge 206 like those described in already discussed U.S. Pat. No. 6,639,134 issued to Applicant. Like the last embodiment, the insert 210 could also be used along with a standard flat soundhole edge arrangement. Further, insert 210 could also be used with any of the soundhole arrangements disclosed in the earlier patent which has been incorporated by reference.

Structurally, the FIG. 4 second embodiment includes a deflection portion 212 which terminates at a lower circular portion 214 and defines a slanted face 216. In cross section, as shown in FIG. 4, face 216 is substantially linear, and ramps upward towards the soundhole. Because of this, sound energy waves striking surface 216 will be directed up and out of the soundhole. A recessed portion 218 also exists which is surrounded by an uppermost ridge 230. Like with the first embodiment, the FIG. 4 device is symmetrical about the center vertical axis of the device. The insides of the deflection portion 212 defines an inner surface 220, thus defining a covered inside chamber 232. The device is supported on a post 238 which exists proximate to and conforms with the center vertical axis of device 210.

Like the FIG. 2 embodiment, the interfacing device of FIG. 4 is also made to be vertically adjustable for tuning purposes. This is done by threading the bottom of post 238, and receiving these threads in corresponding threads in a receiving member 244 which has been mounted internally on the back 204 of the guitar. Thus, but turning device 210 in the chamber it can be vertically raised or lowered to its desired position.

The FIG. 4 embodiment also has a microphone arrangement like that in the first embodiment. One or more microphones 242 will be electrically or wirelessly connected into a sound amplification system. Only one microphone could be used. Or alternatively, two or more could be radially clocked about the upper tip of insert 210.

Acoustically, device 210 works in much the same fashion as does device 110. More specifically, device 210 maintains the amplified sound waves in phase by preventing wave collision proximate and below the soundhole. Device 210 has a tapered cross section which defines a slanted face (in cross section) which serves to deflect the otherwise interfering waves outward in phase.

Another possible embodiment not shown in the figures, is an insert that is made to be collapsible and openable like an umbrella. This device, when in open position, would appear much like FIG. 4, but when closed, shroud 212 would be collapsed onto or proximate to post 238. One skilled in the art will recognize that a circular-hinge arrangement of some sort at point 230 along with a plurality of downwardly extending fan like members could be used to accomplish this. Or a simple umbrella-type arrangement could be used with single wire members supporting a shroud like 212 shown in FIG. 4 when in opened position. Thus, although not shown in the provided figures, that shroud 212 could be retractable is an option.

In terms of the materials used to construct devices 110 and 210, wood and/or plastic could be used to construct the devices. But metals or other materials could be used as well.

As can be seen, the present invention and its equivalents are well-adapted to provide a new and useful methods and devices for creating different tonal characteristics for a stringed instrument. Many different arrangements of the various components depicted, as well as components not shown, are possible without departing from the spirit and scope of the present invention.

The present invention has been described in relation to particular embodiments, which are intended in all respects to be illustrative rather than restrictive. Alternative embodiments will become apparent to those skilled in the art that do not depart from its scope. Many alternative embodiments exist but are not included because of the nature of this invention. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the order described.

The invention claimed is:

1. A device adapted to be mounted within a resonance chamber of a stringed instrument, said stringed instrument including a resonance chamber and a soundboard, said soundboard defining a soundhole where said soundhole is open when the device is installed, the device comprising:

a first surface on an upper portion of said device where said device is substantially symmetrical about a central vertical axis, and said first surface is offset such that the first surface upwardly and outwardly faces an inside edge of the soundhole;

the first surface having an arcuate cross sectional shape which is made to be concave upwardly and outwardly relative to the inside edge of the soundhole; and the device, when installed, is supported from below and occupies a space beneath the soundhole while the soundhole remains open and the first surface is oriented on the upper portion of the device to receive sound energy from the resonance chamber and uniformly reflect the sound energy out of the open soundhole thus changing an acoustical characteristic of the instrument.

2. The device of claim 1 wherein the first arcuate cross sectional shape of the first surface about said first portion is radially symmetrical about an upper portion of said device.

3. The device of claim 1 wherein said device comprises:

a second surface radially located about a lower portion of the device, the second surface including a second arcuate cross sectional shape which is substantially symmetrical about a lower portion of the device and faces downward and outward into the resonance chamber.

4. The device of claim 1 comprising:

a vertical adjustment arrangement which supports the device from below and enables the device to be adjusted vertically within the resonance chamber.

5. The device of claim 4 wherein said vertical adjustment arrangement comprises:

a threaded portion on a lower portion of said device; and a mount on a back of said stringed instrument, said mount having reciprocating threads which receive said threaded portion on said lower portion of said device to make said device vertically adjustable.

6. The device of claim 1 comprising:

a microphone on said device.

7. The device of claim 6 wherein said microphone is located at a topmost portion of said surface near the center of said soundhole.

* * * * *